US007543571B2

(12) United States Patent
Ueno et al.

(10) Patent No.: US 7,543,571 B2
(45) Date of Patent: Jun. 9, 2009

(54) FUEL PUMP MOUNTING STRUCTURAL BODY

(75) Inventors: Masaki Ueno, Saitama (JP); Tomoyuki Tagami, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 14 days.

(21) Appl. No.: 11/588,323

(22) Filed: Oct. 27, 2006

(65) Prior Publication Data

US 2007/0098573 A1 May 3, 2007

(30) Foreign Application Priority Data

Nov. 1, 2005 (JP) ..... 2005-318830

(51) Int. Cl.
*F02M 37/04* (2006.01)

(52) U.S. Cl. ..... 123/509; 123/514; 123/541; 123/495

(58) Field of Classification Search ..... 123/514, 123/541, 518, 41.31, 509, 516, 495; 137/571, 137/592, 263; 222/105; 417/40; 285/189, 285/281, 305, 374; 292/87, 10, 16, 32, 248, 292/342; 24/545, 570, 563
See application file for complete search history.

(56) References Cited

U.S. PATENT DOCUMENTS 3,512,808 A * 5/1970 Graham ..... 285/189
4,672,937 A * 6/1987 Fales et al. ..... 123/509
4,974,570 A * 12/1990 Szwargulski et al. ..... 123/509
5,056,492 A * 10/1991 Banse ..... 123/509
5,060,826 A * 10/1991 Coleman ..... 222/95
5,282,550 A * 2/1994 Coleman ..... 222/105
5,427,074 A * 6/1995 Tuckey ..... 123/514
7,311,088 B1 * 12/2007 Callahan et al. ..... 123/519

FOREIGN PATENT DOCUMENTS

EP 1 571 030 A2 9/2005
JP 2001-270337 A 10/2001
JP 2002-276495 A 9/2002
JP 2005-113892 A 4/2005

* cited by examiner

*Primary Examiner*—Stephen K Cronin
*Assistant Examiner*—Keith Coleman
(74) *Attorney, Agent, or Firm*—Birch, Stewart, Kolasch & Birch, LLP

(57) ABSTRACT

To provide a fuel pump mounting structural body that allows a mounting space for a fuel tank and the number of manufacturing processes to be reduced. A fuel pump mounting structural body accommodates a fuel pump unit in an opening portion disposed in a fuel tank. The structural body includes a step portion disposed in the opening portion. The step portion is formed one step lower than a wall surface of the fuel tank. A lid portion of the fuel pump unit is fittingly attached to the step portion and includes a delivery port for fuel. A guide member is disposed on a peripheral edge of the opening portion. The guide member includes a removably mounted holding member. The fuel pump unit is held in position by the fuel pump mounting structural body.

18 Claims, 9 Drawing Sheets

FUEL PUMP MOUNTING STRUCTURAL BODY

CROSS-REFERENCE TO RELATED APPLICATIONS

This nonprovisional application claims priority under 35 U.S.C. § 119(a) on Patent Application No. 2005-313830, filed in Japan on Nov. 1, 2005, the entirety of which is incorporated herein by reference.

BACKGROUND OF THE INVENTION

1. Field of the Invention

The present invention relates generally to a fuel pump mounting structural body and. More particularly, the present invention relates to a fuel pump mounting structural body that allows a mounting space and the number of manufacturing processes to be reduced.

2. Description of Background Art

In a mounting structure for a fuel pump built into a fuel tank, a technique for securing the fuel pump in the fuel tank is known. Specifically, the technique include inserting the fuel pump of a substantially cylindrical shape through an opening portion included in the fuel tank and fastening a flange portion formed on a first end of the fuel pump with a flange portion formed on the opening portion using a mounting bolt.

Japanese Patent Laid-open No. 2005-113892 discloses a fuel pump case having the following arrangements. Specifically, a sealing member is disposed between the flange portion on the side of the fuel tank and that on the side of the fuel pump. An edge of the flange portion on the side of the fuel pump is bent onto the side of the fuel tank. The bent portion is then adapted to have a height that results in the sealing member exhibiting a predetermined sealing effect. According to the fuel pump case, the mounting bolt is tightened until the bent portion abuts against the flange portion on the side of the fuel tank, at which the predetermined sealing effect is exhibited. Accordingly, control of a tightening margin of the mounting bolt that achieves the predetermined sealing effect can be easily made by adjusting the height of the bent portion.

In Japanese Patent Laid-open No. 2005-113892; however, an annular surface seal formed of a flat material is used for the sealing member. This makes it necessary to weld an annular member having a diameter larger than that of the flange portion on the side of the fuel pump to the fuel tank. This increases the mounting space required for the fuel pump. In addition, the number of parts used and the manufacturing processes involved are increased because of a plurality of mounting bolts for tightening the fuel pump.

SUMMARY OF THE INVENTION

It is an object of the present invention to provide a fuel pump mounting structural body that allows the mounting space and the number of manufacturing processes to be reduced by solving the aforementioned problems of the background art.

To achieve the foregoing object, a first aspect of the present invention provides a fuel pump mounting structural body accommodating a fuel pump unit in an opening portion disposed in a fuel tank. The fuel pump mounting structural body includes a step portion, a lid portion, and a guide member. Specifically, the step portion is disposed in the opening portion and is formed one step lower than a wall surface of the fuel tank. The lid portion of the fuel pump unit is fittingly attached to the step portion and includes a delivery port of fuel. The guide member is disposed on a peripheral edge of the opening portion. According to the first aspect of the present invention, the guide member includes a holding member that holds the lid portion and the holding member is mounted removably, whereby the fuel pump unit is held in position.

According to a second aspect of the present invention, the holding member is formed of a sheet-like elastic body, and the holding member includes an engagement portion engaged with the guide member and a pressure portion pressing the lid portion.

According to a third aspect of the present invention, the holding member includes a substantially U-shaped engagement portion including the engagement portion and a substantially U-shaped pressure member including the pressure portion. The pressure member is disposed on an inside of the engagement member. Furthermore, the engagement portion and the pressure portion are connected together by a connection portion.

According to a fourth aspect of the present invention, the pressure member includes a lock portion restricting movement of the holding member by being in abutment against the guide member. Furthermore, the lock portion is arranged so as not to be released from a condition of being locked with the guide member unless a predetermined operation is executed.

According to a fifth aspect of the present invention, the lid portion includes at least one protruding portion that abuts on the pressure member to produce a pressing force acting on the lid portion.

According to a sixth aspect of the present invention, the step portion includes a sealing member disposed on an inner peripheral portion thereof The lid portion has a bottom portion thereof abutted against a bottom portion of the step portion. Furthermore, the sealing member is made to abut against an outer peripheral portion of the lid portion and the step portion. A sealing effect is thereby produced.

According to a seventh aspect of the present invention, the sealing member includes an O-ring having a substantially circular cross section.

According to an eighth aspect of the present invention, the step portion is formed on a base member separate from the fuel tank. Furthermore, the base member is attached to the opening portion through a projection welding process.

According to a ninth aspect of the present invention, the step portion is formed by processing a sheet-like member constituting the fuel tank.

According to the first aspect of the present invention, the fuel pump unit can be secured in position by the holding member. This eliminates the need for mounting bolts and allows parts involved in mounting to be made more compact. As a result, the fuel pump unit requires an installation space that is substantially reduced. The arrangement further eliminates the need for a step of tightening the mounting bolts, thus reducing the number of assembly processes.

According to the second aspect of the present invention, the holding member can be assigned with two following functions simultaneously, namely, a function of being engaged with the guide member and a function of pressing the lid portion.

According to the third aspect of the present invention, the holding member can be formed as a single component that connects the substantially U-shaped engagement portion having the function of being engaged with the guide member and the substantially U-shaped pressure member having the function of pressing the lid portion.

According to the fourth aspect of the present invention, the structural body includes the lock function that allows the holding member to be moved from a predetermined position only when a predetermined operation is executed. This allows the fuel pump unit to be removed and reinstalled reliably and easily.

According to the fifth aspect of the present invention, the protruding portion disposed on the lid portion allows the lid portion to produce a pressing force.

According to the sixth aspect of the present invention, adjusting the shape of the bottom portion of the lid portion and the step portion allows a predetermined sealing effect to be stably exhibited. In addition, the shape of the bottom portion of the lid portion and the step portion of the opening portion defines a specific location at which the sealing member is disposed. This helps reduce the number of assembly processes.

According to the seventh aspect of the present invention, space requirements for installing the fuel pump unit can be substantially reduced, as compared with an annular seal by means of a flat member.

According to the eighth aspect of the present invention, it is not necessary to process the opening portion of the fuel tank into a complicated shape having a step portion. As a result, the number of manufacturing processes can be reduced.

According to the ninth aspect of the present invention, the arrangement eliminates the need for any base members. This contributes to not only a reduced number of parts used, but also a reduced overall height, by a thickness of the base member, of the fuel pump unit when mounted in position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
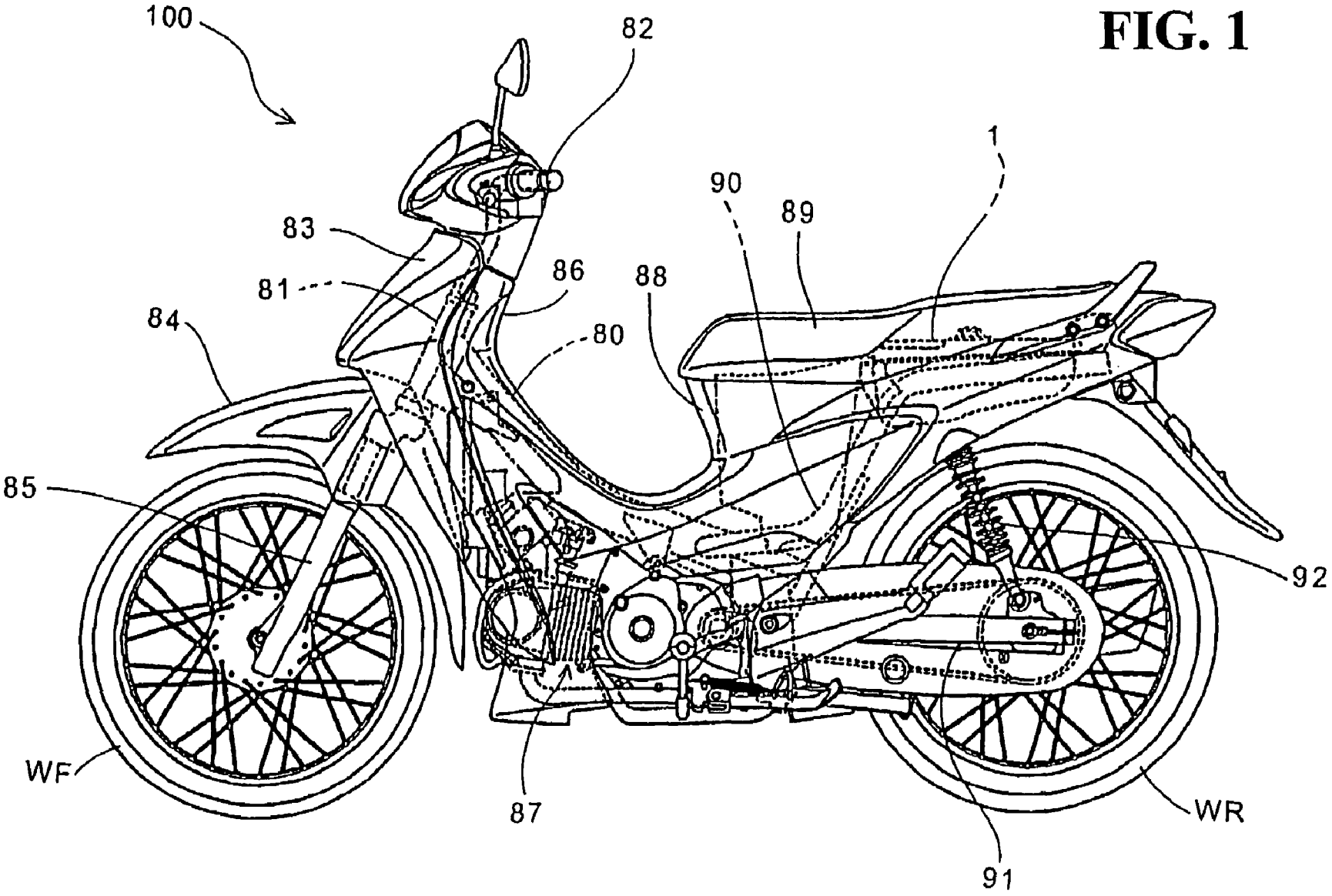
FIG. 1 is a side elevational view showing a motorcycle, to which a member joining method according to an embodiment of the present invention is applied.

An embodiment of the present invention will now be described with reference to the accompanying drawings. The same reference numerals will be used to identify the same or similar elements throughout the several views. It should be noted that each of the drawings should be viewed in the direction of orientation of the reference numerals.

FIG. 1 is a side elevational view showing a motorcycle 100 according to an embodiment of the present invention. A pair of left and right front forks 85 is rotatably attached to a head pipe 81 that is fixedly connected to a main frame 80. A front wheel WF is rotatably supported at a lower end portion of the front forks 85. The front forks 85 can be steered by a handlebar 82. A front fender 84 covering an area upward of the front wheel WF is steered integrally with the front forks 85. A front cover 83 is disposed upward of the front fender 84. The front cover 83 covers, with an upper cover 86, the main frame 80. An engine 87 as an internal combustion engine is fixedly suspended at an area downward of the main frame 80. Connected rearward of the main frame 80 is a seat frame 90 that supports a body cover 88, a seat 89 on which an occupant sits, and the like. A fuel tank 1 is disposed downward of the seat 89 at a position rearward of the vehicle. A swing arm 91 has a proximal end axis attached to a lower portion rearward of the main frame 80. The swing arm 91 is swingable with the proximal end axis as a pivot and is suspended by a rear cushion 92 connected to the seat frame 90. A rear wheel WR as a drive wheel is rotatably supported on a distal end portion of the swing arm 91. A fuel pump mounting structural body according to the embodiment of the present invention is applied to the fuel tank 1.

Figure 2:
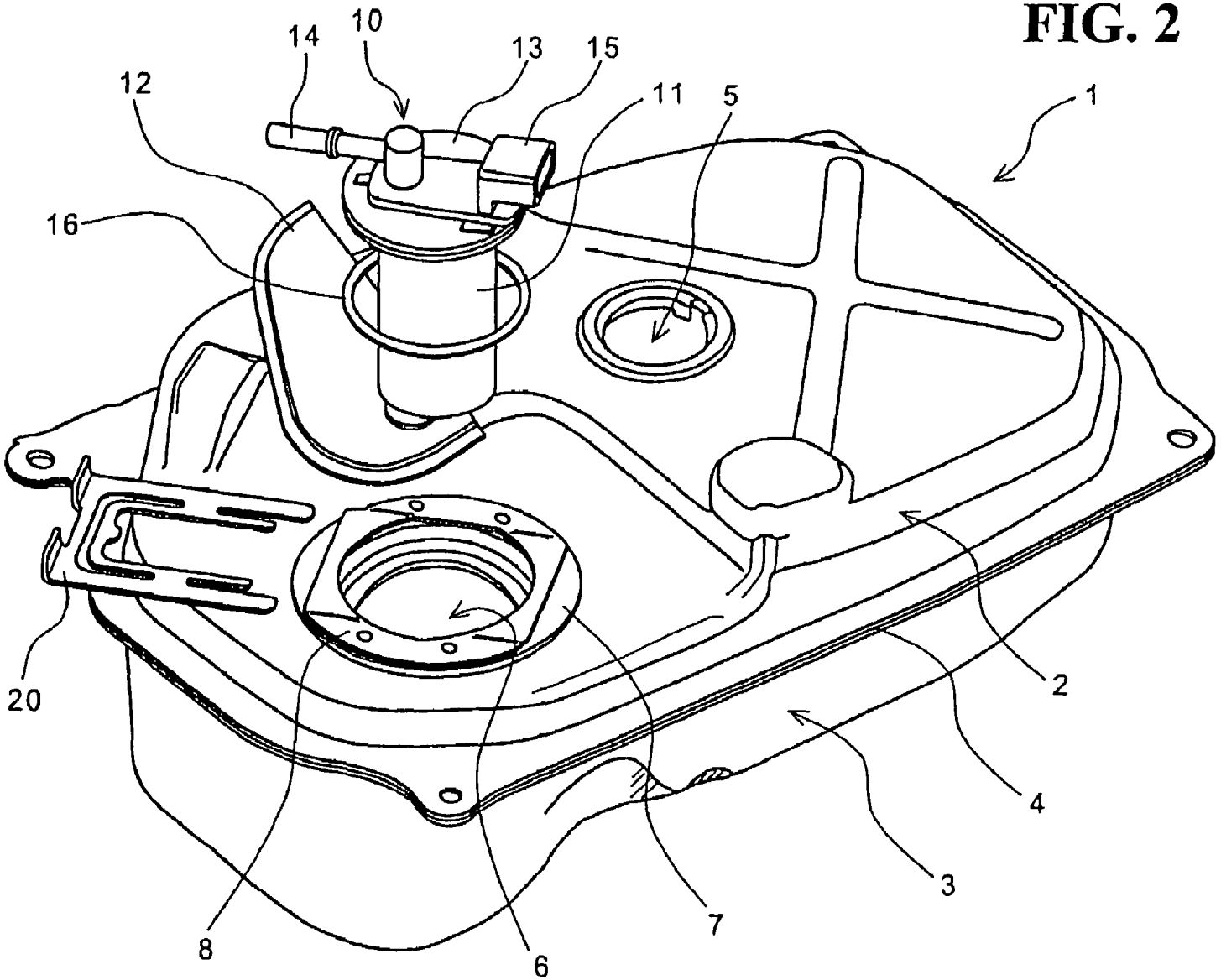
FIG. 2 is a perspective view showing a fuel tank, to which a fuel pump mounting structural body according to the embodiment of the present invention is applied.

FIG. 2 is a view illustrating generally the fuel tank 1, to which the fuel pump mounting structural body according to the embodiment of the present invention is applied. The fuel tank 1 includes an upper member 2, a lower member 3, and a peripheral edge portion 4 of each of the upper and lower members 2, 3. The upper member 2 and the lower member 3, both pressformed from a steel sheet, are welded together at the peripheral edge portions 4. The fuel tank 1 is thus formed into an integrated container. The upper member 2 includes a fuel filler port 5 and an opening portion 6 for mounting a fuel pump unit 10, disposed on an upper surface portion thereof A detachable or openable lid is fitted, when the fuel tank 1 is mounted in the vehicle, to an upper portion of the fuel filler port 5, which is opened and closed for each refueling operation. The opening portion 6, on the other hand, is to be opened only when the fuel pump unit 10 is serviced or otherwise handled, once the fuel pump unit 10 is mounted at the time of assembly of the fuel tank 1.

The fuel pump unit 10 includes a lid portion 13, a main body portion 11, and a strainer 12. The lid portion 13 includes a delivery nozzle 14 that delivers fuel and a connector 15 that receives a drive signal for the drive motor. The main body portion 11 has a substantially cylindrical shape and includes the drive motor built therein. The drive motor sends fuel in the fuel tank 1 under pressure. The strainer 12 includes a filter built therein for filtering impurities and the like contained in the fuel. The main body portion 11 and the strainer 12 are connected to a lower portion of the lid portion 13.

A base 7 and a plate 8 are joined to the opening portion 6. The base 7 serves as a base member for mounting the fuel pump unit 10. The plate 8 serves as a guide member. The base 7 is joined to the upper member 2 through a projection welding process as detailed below. Specifically, projections are provided on components of a weld to be made. Current is passed through welding electrodes that are disposed vertically. Heat and pressure are thus localized at the projections, so that melt or plastic flow occurs in the projections to make the weld. The plate 8 is joined to an upper surface of the base 7 through spot welding at four locations.

An O-ring 16 is disposed between an inner wall surface of the base 7 and the lid portion 13. The O-ring 16 has a substantially circular cross section and is formed from an elastic resin or the like to serve as a hermetic seal. The entire fuel pump unit 10 is inserted through the opening portion 6 and then a retainer 20 as a retaining bracket is mounted, so that the fuel pump unit 10 is secured to the fuel tank 1 in a hermetically sealed state.

Figure 3:
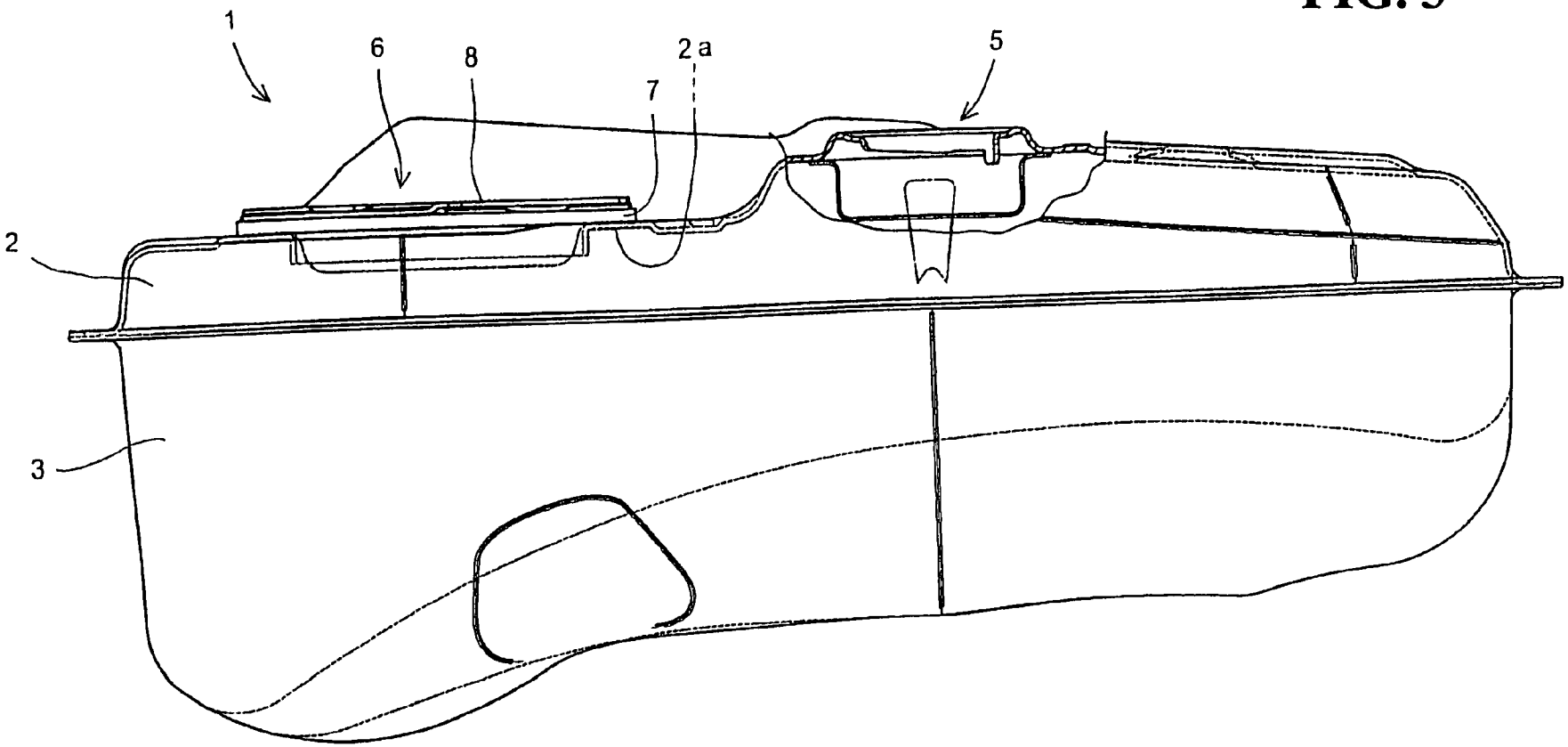
FIG. 3 is a side elevational view showing the fuel tank, to which the fuel pump mounting structural body according to the embodiment of the present invention is applied.

FIG. 3 is a side elevational view showing the fuel tank 1. Like reference symbols represent the same or equivalent parts as those shown in FIG. 2. A steel sheet 2*a* forming the upper member 2 is bent substantially at right angles in a direction of the lower member 3 at a peripheral edge portion of the opening portion 6. Projection welding between the steel sheet 2*a* and the base 7 is performed throughout an entire periphery of the base 7 at a peripheral edge portion thereof In addition, the plate 8 includes a step for allowing a gap from the base 7, through which the retainer 20 can be inserted.

Figure 4:
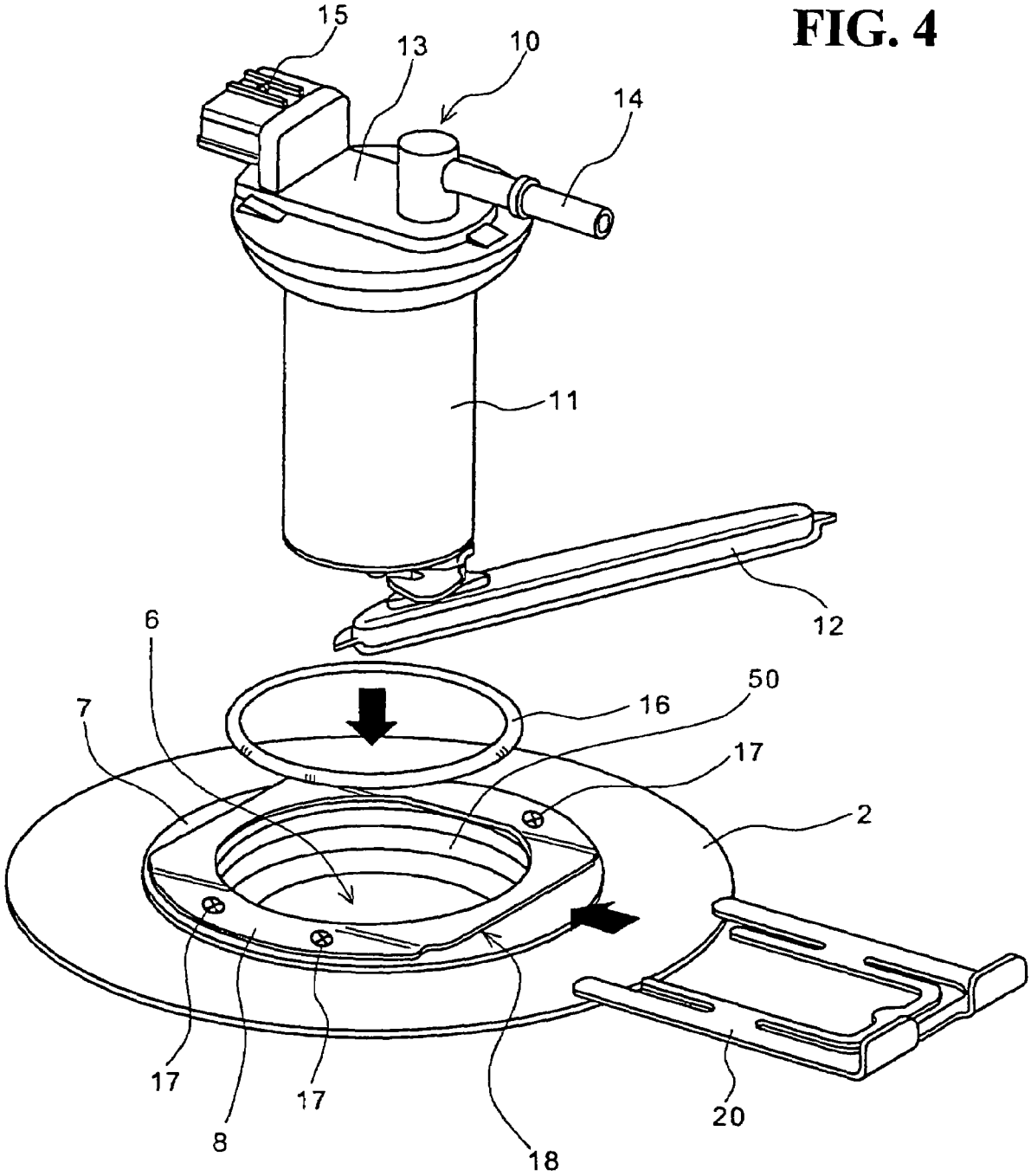
FIG. 4 is a view illustrating generally the fuel pump mounting structural body according to the embodiment of the present invention.

FIG. 4 is a view illustrating generally the fuel pump mounting structural body according to the embodiment of the present invention. Like reference symbols represent the same or equivalent parts as those shown in FIG. 2. Referring to FIG. 4 that is a view seen from a direction in which the retainer 20 is inserted, installation procedures for the fuel pump unit 10 will be described. The O-ring 16 is first disposed so as to be fitted in a step portion 50 formed in an inner peripheral portion of the base 7. The fuel pump unit 10 is next inserted into the opening portion 6, while being tilted with a leading end of the strainer 12 first. When the whole main body portion 11 is placed in the opening portion 6, the O-ring 16 is designed to exhibit a sealing effect between an outer peripheral portion of the lid portion 13 and the step portion 50 in the base 7. The retainer 20 is then inserted into a gap 18 between the base 7 and the plate 8 in this condition. This causes a leading end portion of the retainer 20 to slide over an upper surface side of the lid portion 13 to advance into the gap 18 on the side opposite to the inserting direction. Through the arrangements as described heretofore, the fuel pump unit 10 retains a condition of being fixed to the fuel tank 1 unless the retainer 20 is removed. According to the embodiment of the present invention, the plate 8 and the base 7 are spot-welded together at four locations of spot welds 17. It should, however, be noted that the number of spot welds is not limited to four.

Figure 5:
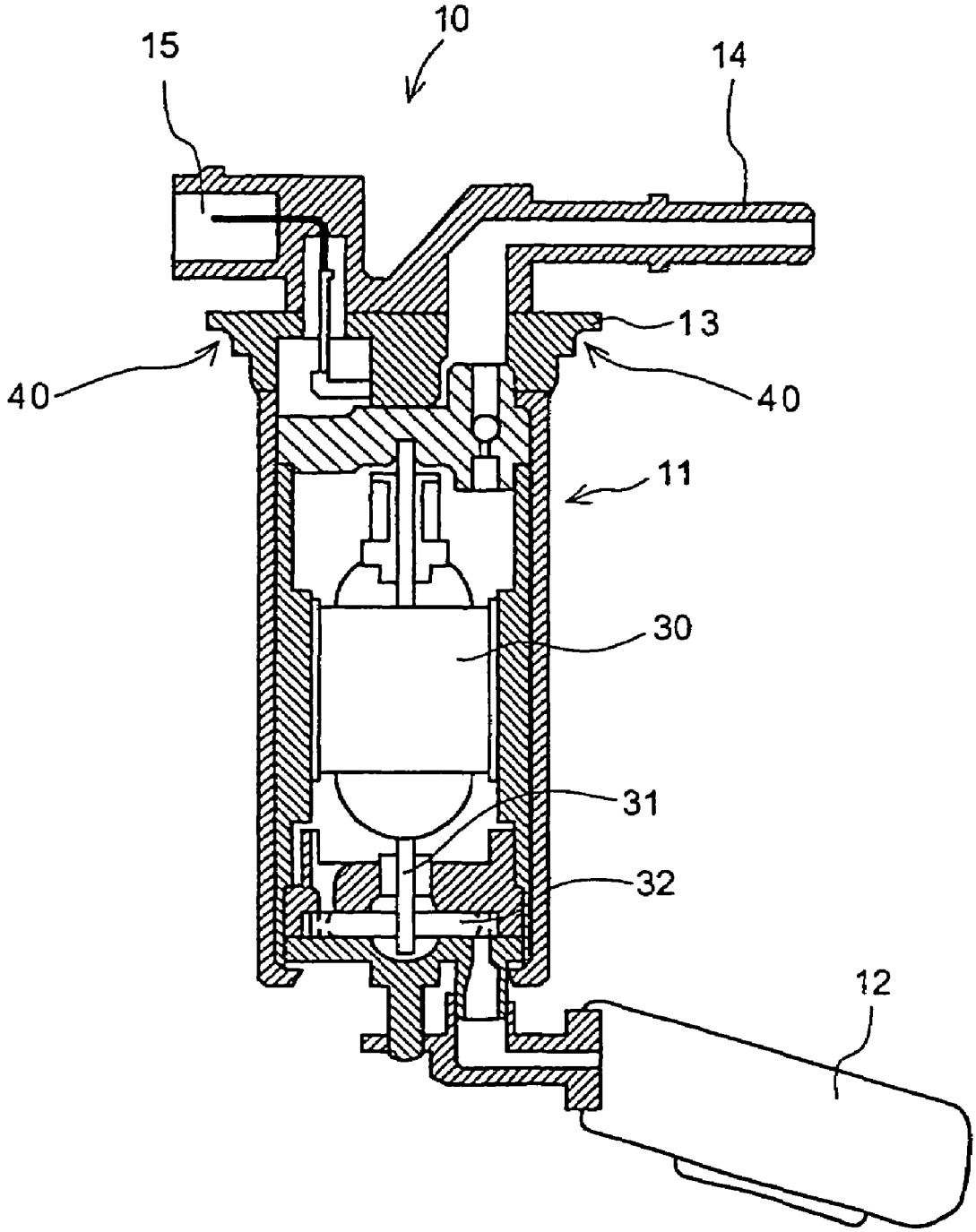
FIG. 5 is a cross-sectional view showing the fuel pump unit according to the embodiment of the present invention.

FIG. 5 is a cross-sectional view showing the fuel pump unit 10 according to the embodiment of the present invention. Like reference symbols represent the same or equivalent parts as those shown in FIG. 2. The fuel pump unit 10 has a drive motor 30 built into the main body portion 11 that is a cylindrical housing. A vaned disc impeller 32 is mounted on a rotary shaft 31 of the drive motor 30. When the connector 15 receives a drive signal from an ECU (not shown), thus rotating the drive motor 30, the impeller 32 is rotated to draw fuel from the strainer 12. Fuel drawn by a rotating force of the impeller 32 is sent under pressure upward of the fuel pump unit 10, while lubricating internal parts of the drive motor 30. The fuel is then delivered from the delivery nozzle 14 toward a fuel injection unit that supplies the engine 87 with fuel. The fuel pump mounting structural body according to the embodiment of the present invention uses the O-ring 16 having a substantially circular cross section as the sealing member for providing a hermetic seal relative to the plate 8. This allows a step portion 40 in abutment with the O-ring 16 to be made substantially compact as compared with a counterpart used in the known system that uses the annular surface seal formed of a flat material. In response to this, the fuel pump unit 10 is configured as having "upward delivery specifications," with which the delivery nozzle 14 and the connector 15 are disposed on the upper surface of the lid portion 13.

Figure 6A:
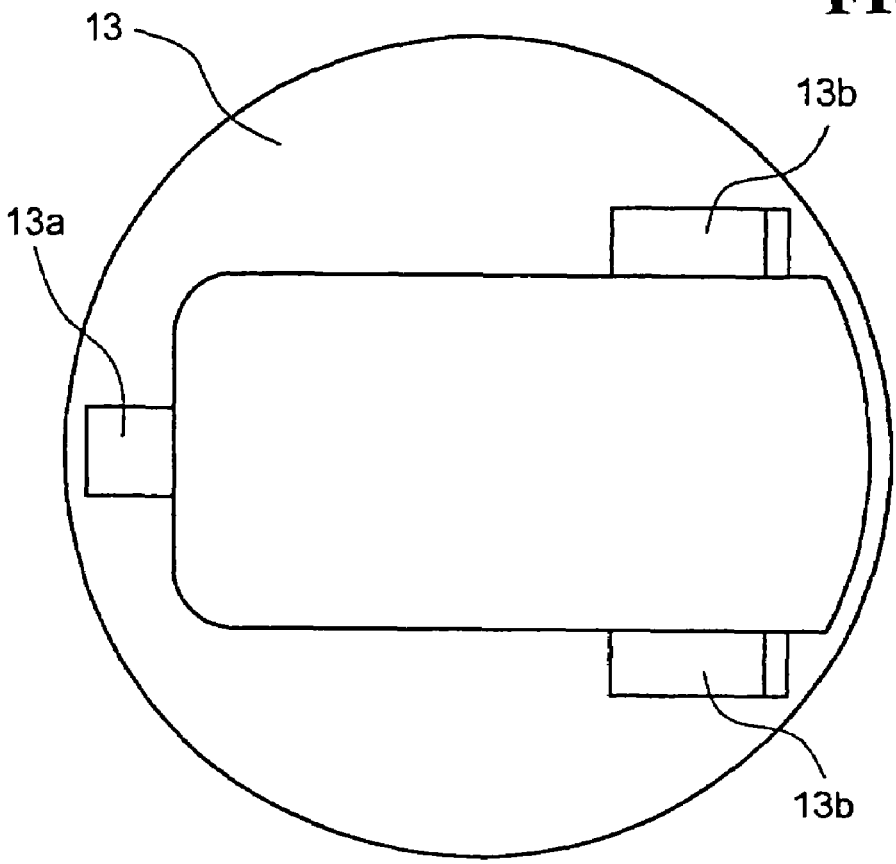
FIGS. 6(*a*) and 6(*b*) are a plan view and a side elevational view, respectively, showing a lid portion.
Figure 6B:
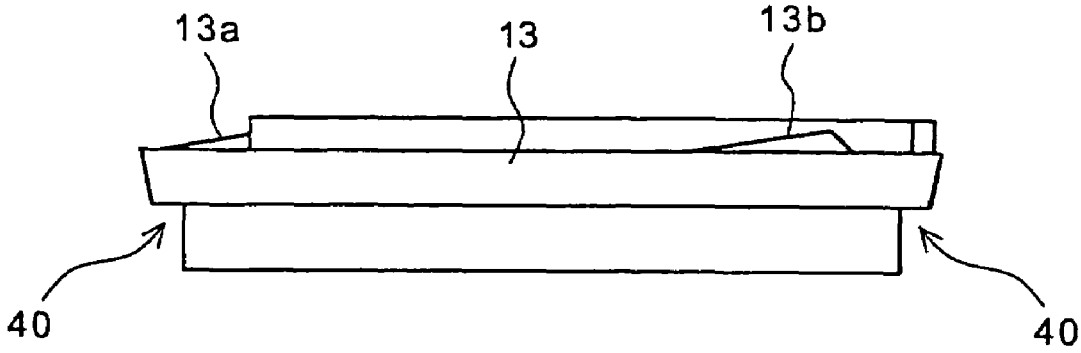

FIGS. 6(*a*) and 6(*b*) are a plan view and a side elevational view, respectively, showing the lid portion 13. Like reference symbols represent the same or equivalent parts as those shown in FIG. 5. The fuel pump mounting structural body according to the embodiment of the present invention is designed such that, as long as the retainer 20 is fixed at a predetermined position, the retainer 20 can no longer be removed (that is, the retainer 20 is locked in position) unless a predetermined operation is intentionally performed. This lock function is achieved mainly by the shapes of the lid portion 13 and the retainer 20. The lid portion 13 shown in FIGS. 6(*a*) and 6(*b*) includes slopes 13*a*, 13*b* as protruding portions at three locations that are brought in abutment with any arbitrary portions of the substantially U-shaped retainer 20 as the retainer 20 is inserted. Each of these slopes 13*a*, 13*b* is inclined to rise moderately from the direction, in which the retainer 20 is inserted.

Figure 7A:
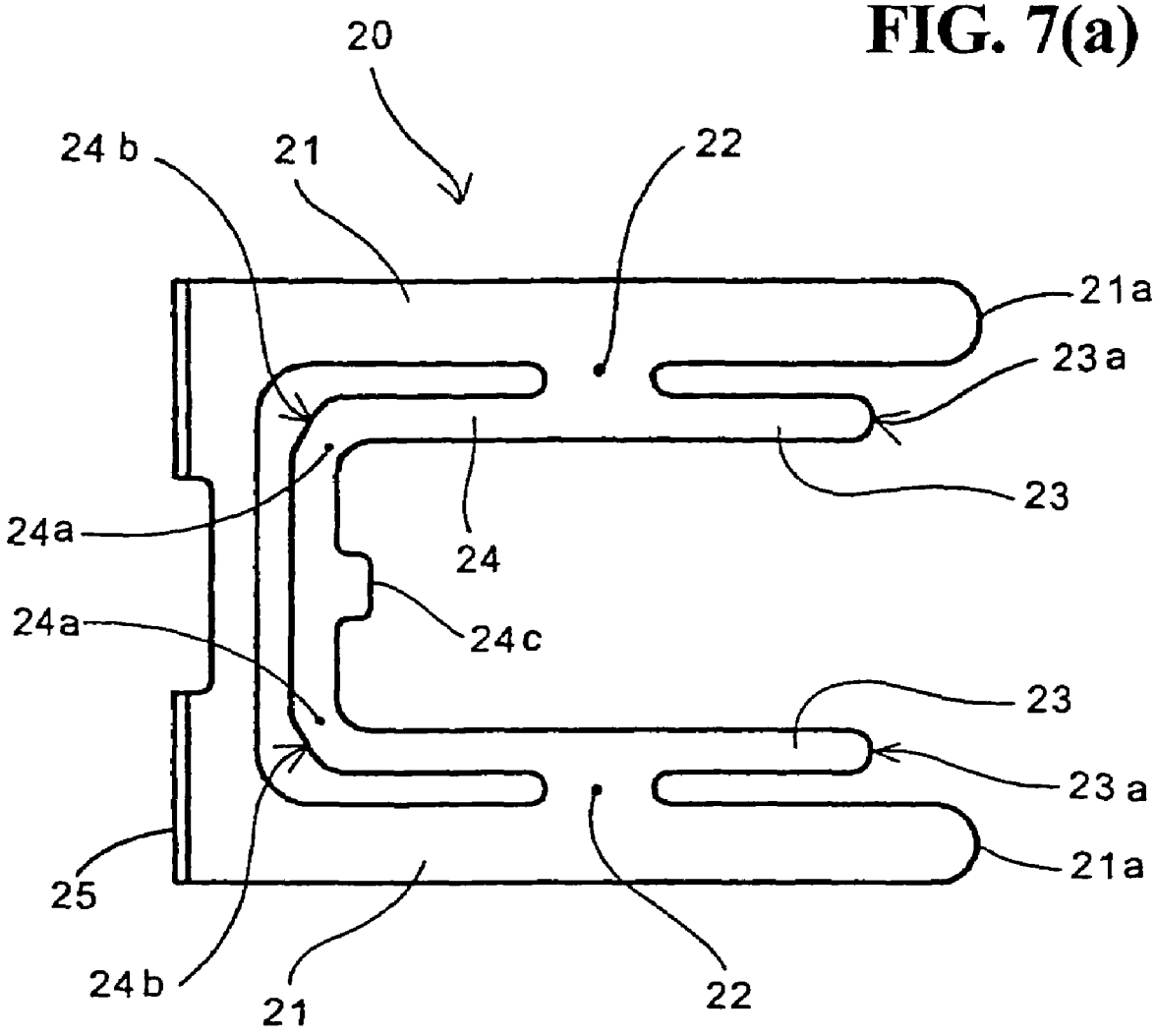
FIGS. 7(*a*) and 7(*b*) are a plan view and a side elevational view, respectively, showing a retainer.
Figure 7B:
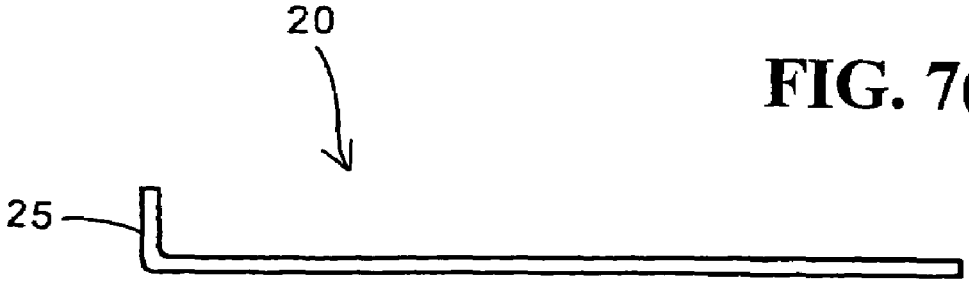
Figure 8:
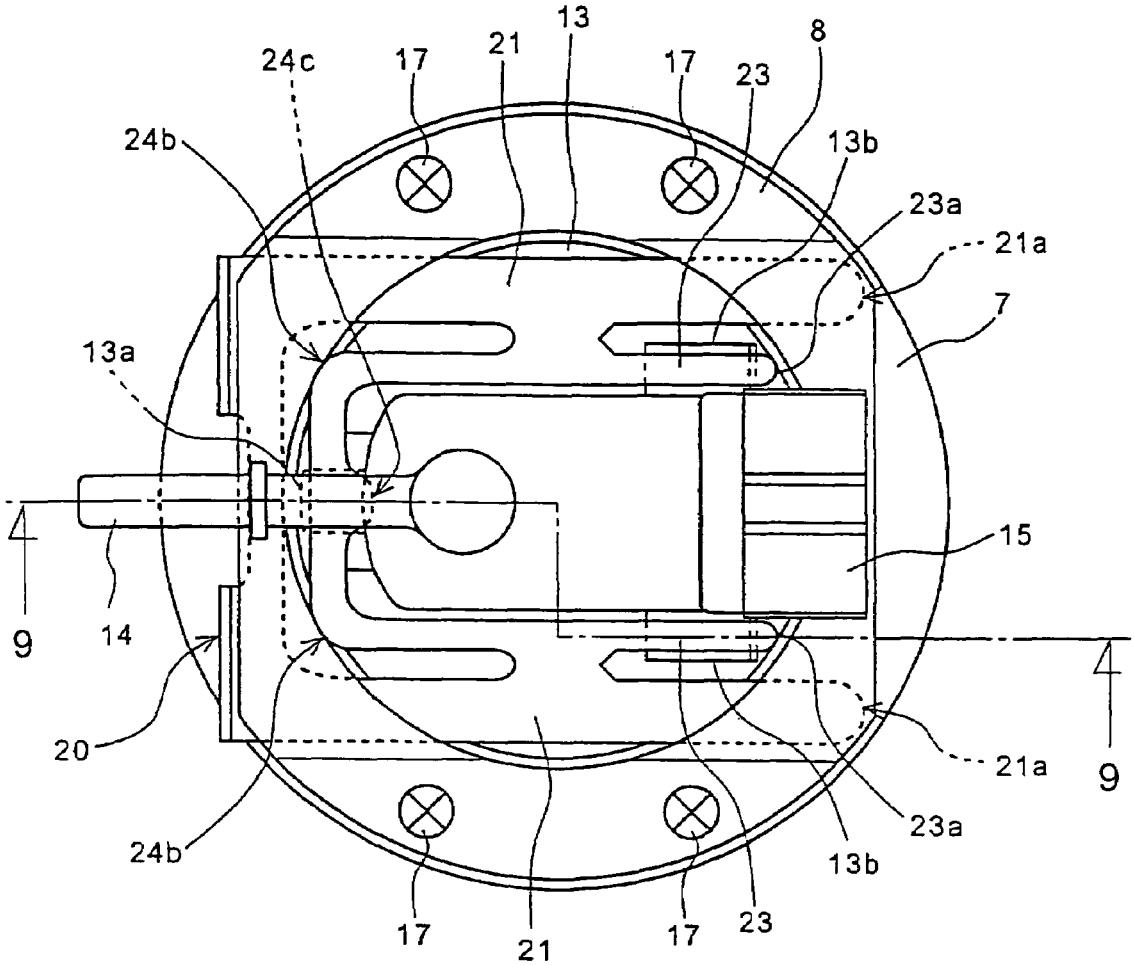
FIG. 8 is a plan view showing the fuel pump mounting structural body according to the embodiment of the present invention.
Figure 9:
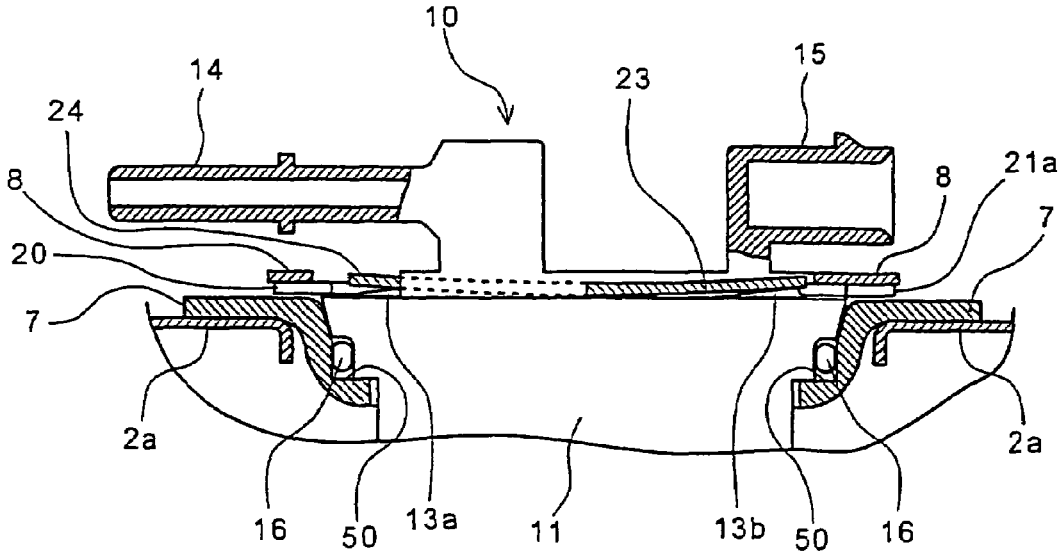
FIG. 9 is a cross-sectional view taken along line 9-9 of FIG. 8.

FIGS. 7(*a*) and 7(*b*) are a plan view and a side elevational view, respectively, showing the retainer 20. Like reference symbols represent the same or equivalent parts as those shown in FIG. 2. The retainer 20 is formed from a thin steel sheet or the like that undergoes elastic deformation when an external stress is applied thereto and restores to its original shape when released from the stress. The retainer 20 is supposed to be a flat portion except for a bent portion 25 serving as a handle. The flat portion of the retainer 20 includes a main plate 21 and sub-plates 23, 24. The sub-plates 23, 24, which serve as a pressure member, are connected by a connection portion 22 with the main plate 21. The sub-plate 23 has a leading end portion 23*a*, which serves as a lock portion and is shorter in length than a leading end portion 21*a* of the main plate 21. In addition, the sub-plate 24, which is substantially U-shaped, includes a protruding portion 24*c* at a central portion thereof The protruding portion 24*c* protrudes in a direction of inserting the retainer 20. The sub-plate 24 also includes a substantially straight lock portion 24*b* on an outer peripheral side of each of two bent portions 24*a* thereof FIG. 8 is a plan view showing the fuel pump mounting structural body according to the embodiment of the present invention. Like reference symbols represent the same or equivalent parts as those shown in the foregoing Figues. FIG. 8 shows a condition, in which the fuel pump unit 10 is secured in position to the fuel tank 1. The lock function of the retainer 20 will hereinafter be described in detail with reference to FIG. 8, and FIG. 9 that is a cross-sectional view taken along line 9-9 of FIG. 8.

First, the fuel pump unit 10 is inserted in the opening portion 6 (see FIG. 4) and pushed thereinto until a bottom surface of the lid portion 13 abuts on the step portion 50 in the base 7. This deforms the O-ring 16, so that the predetermined sealing effect is achieved. When the retainer 20 is inserted into the gap 18 (see FIG. 4) formed between the base 7 and the plate 8 from the left in FIG. 8, the leading end portions 21*a* of the main plates 21 of the retainer 20 slide along the upper surface of the lid portion 13 to be engaged with the plate 8 as the guide member, then reaching the gap 18 on the right in FIG. 8. At this time, the leading end portions 23*a* of the sub-plates 23 follow along the slopes 13*b* to be warped upward, thus elastically deforming the sub-plates 23. As a result, the sub-plates 23 press the lid portion 13 with the leading end portions 23*a* thereof abutting or substantially abutting on a side surface portion on an inner periphery of the plate 8.

The protruding portion 24*c* of the sub-plate 24, on the other hand, follows the slope 13*a* of the lid portion 13 to be warped upward, thus elastically deforming the sub-plate 24. As a result, the sub-plate 24 presses the lid portion 13 and the lock portions 24*b* thereof abut or substantially abut on the side surface portion on the inner periphery of the plate 8. Through these operations, the retainer 20 is subjected to a lock function, with which the retainer 20 is not able to move in the insertion or withdrawal directions by the functioning of the sub-plates 23, 24 warped upward by the slopes 13*a*, 13*b*.

It is to be noted that the fuel pump unit 10 may be removed from the fuel tank 1 through the following procedure. Specifically, a predetermined operation is executed, that is, pressing downward areas near the lock portions 24*b* of the sub-plate 24. While the sub-plate 24 is elastically deformed to disengage the lock portions 24*b* by the predetermined operation, the retainer 20 is pulled out in the withdrawal direction.

Figure 10:
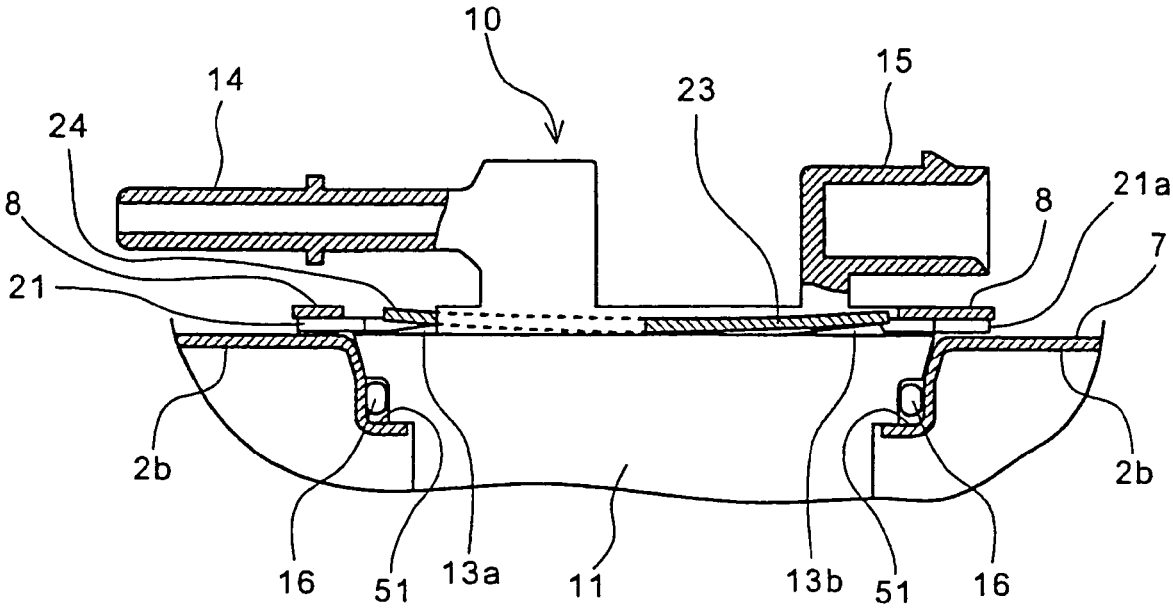
FIG. 10 is a cross-sectional view showing a fuel pump mounting structural body according to a second embodiment of the present invention.

FIG. 10 is a cross-sectional view showing a fuel pump mounting structural body according to a second embodiment of the present invention. Like reference symbols represent the same or equivalent parts as those of the fuel pump mounting structural body according to the first embodiment of the present invention. A cross-sectional line in FIG. 10 corresponds to line 9-9 of FIG. 8. The fuel pump mounting structural body according to the second embodiment of the present invention is characterized in that a steel sheet 2*b* that forms an upper member 2 of a fuel tank 1 (see FIG. 2) is formed so as to be directly mounted on a fuel pump unit 10 without using a base 7 (see FIG. 9) interposed therebetween. Specifically, a step portion 51 is formed in the steel sheet 2*b* through press-forming or the like, so that a lid portion 13 and an O-ring 16 are directly engaged with the step portion 51. The fuel pump mounting structural body according to the second embodiment of the present invention eliminates the base 7 separate from the upper member 2 and reduces the manufacturing process of welding the base 7 to the upper member 2. Furthermore, a reduced thickness corresponding to that of the base 7 reduces a protruding height of a delivery nozzle 14 and a connector 15 with respect to the upper member 2.

As described heretofore, the fuel pump mounting structural body according to the second embodiment of the present invention uses the O-ring having a substantially circular cross section for the sealing member and eliminates the need of mounting bolts. Accordingly, parts involved in mounting the fuel pump unit can be made smaller in diameter, which substantially reduces space requirements for installation. In addition, the fuel pump unit can be secured in position in a hermetically sealed state by simply inserting the retainer, while eliminating the use of mounting bolts. As a result, the number of assembly processes can be reduced. Furthermore, the fuel pump mounting structural body according to the second embodiment of the present invention is adapted to offer the lock function that requires that a predetermined operation be executed before the retainer can be removed because of the shapes of the lid portion and the retainer. This helps remove and reinstall the fuel pump unit reliably and easily.

It is to be noted herein that the present invention can be implemented in a variety of other manners, in terms of the shape and material used of the fuel tank, disposition, shape, and construction of the O-ring and retainer. For example, the fuel pump unit may be mounted on a lower surface side of the fuel tank.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel pump mounting structural body accommodating a fuel pump unit in an opening portion disposed in a fuel tank, the structural body comprising:

a step portion disposed in the opening portion, the step portion being formed one step lower than a wall surface of the fuel tank;

a lid portion of the fuel pump unit, the lid portion fittingly attached to the step portion and including a delivery port for fuel; and a guide member disposed on a peripheral edge of the opening portion, the guide member including a holding member pressing the lid portion towards the step portion, the holding member being mounted removably, the holding member being formed of a substantially u-shaped sheet-like elastic body, whereby the fuel pump unit is held in position, wherein the holding member includes:

a substantially u-shaped engagement member;

a substantially u-shaped pressure member, the pressure member being disposed inside the engagement member; and the engagement member and the pressure member being connected together by a connection member.

2. The fuel pump mounting structural body according to claim 1, wherein the engagement member engages the guide member and the pressure member presses the lid portion.

3. The fuel pump mounting structural body according to claim 1, wherein the pressure member includes a lock portion restricting movement of the holding member by being in abutment against the guide member, and wherein the lock portion is arranged so as not to be released from a condition of being locked with the guide member unless a predetermined operation is executed.

4. The fuel pump mounting structural body according to claim 1, wherein the lid portion includes at least one protruding portion that abuts on the pressure member to produce a pressing force acting on the lid portion.

5. The fuel pump mounting structural body according to claim 1, wherein the step portion includes a sealing member disposed on an inner peripheral portion, the lid portion has a bottom portion, abutted against a bottom portion of the step portion, and the sealing member is made to abut against an outer peripheral portion of the lid portion and the step portion to produce a sealing effect.

6. The fuel pump mounting structural body according to claim 5, wherein the sealing member includes an O-ring having a substantially circular cross section.

7. The fuel pump mounting structural body according to claim 1, wherein the step portion is disposed on a base member separate from the fuel tank, and the base member is attached to the opening portion through a projection welding process.

8. The fuel pump mounting structural body according to claim 1, wherein the step portion is formed in a portion of a sheet-like member constituting the fuel tank.

9. A structural body for mounting a fuel pump in an opening of a fuel tank, the structural body comprising:

a step formed in the opening of the fuel tank, the step being formed below a wall surface of the fuel tank;

a lid of the fuel pump, the lid being received by the step;

a guide member disposed on a peripheral edge of the opening; and a retainer for removably securing the lid of the fuel pump to the guide member to hold the fuel pump in position on the fuel tank, the retainer including:

a substantially u-shaped engagement member;

a substantially u-shaped pressure member, the pressure member being disposed inside the engagement member; and the engagement member and the pressure member being connected together by a connection member.

10. The structural body according to claim 9, wherein the retainer is formed of a sheet-like elastic body, and wherein the engagement member engages the guide member and the pressure member presses the lid.

11. The structural body according to claim 9, wherein the pressure member includes a lock portion restricting movement of the retainer by being in abutment against the guide member, and wherein the lock portion is arranged so as not to be released from a condition of being locked with the guide member unless a predetermined operation is executed.

12. The structural body according to claim 9, wherein the lid includes at least one protruding portion that abuts on the pressure member to produce a pressing force acting on the lid.

13. The structural body according to claim 9, wherein the step includes a sealing member disposed on an inner peripheral portion, the lid has a bottom portion, abutted against a bottom portion of the step, and the sealing member is made to abut against an outer peripheral portion of the lid and the step to produce a sealing effect.

14. The structural body according to claim 13, wherein the sealing member includes an O-ring having a substantially circular cross section.

15. The structural body according to claim 9, wherein the step is disposed on a base member separate from the fuel tank, and the base member is attached to the opening through a projection welding process.

16. The structural body according to claim 9, wherein the step is formed in a portion of a sheet-like member constituting the fuel tank.

17. The fuel pump mounting structural body according to claim 1, wherein the guide member is a plate.

18. The structural body according to claim 1, wherein the connection portion member is arranged on the centerline of the lid.

* * * * *